United States Patent [19]

Karrenbauer

[11] 4,211,904

[45] Jul. 8, 1980

[54] GAS-BLAST CIRCUIT BREAKER

[75] Inventor: Herbert Karrenbauer, Niestetal, Fed. Rep. of Germany

[73] Assignee: Licentia Patent-Verwaltungs-G.m.b.H., Frankfurt am Main, Fed. Rep. of Germany

[21] Appl. No.: 881,719

[22] Filed: Feb. 27, 1978

[30] Foreign Application Priority Data

Feb. 28, 1977 [DE] Fed. Rep. of Germany ..... 2708546

[51] Int. Cl.[2] ..... H01H 33/70

[52] U.S. Cl. ..... 200/148 A; 200/148 F

[58] Field of Search ..... 200/148 R, 148 A, 148 B, 200/148 C, 148 D, 148 E, 148 F, 148 G, 148 H, 148 J, 148 BV, 150 G

[56] References Cited

U.S. PATENT DOCUMENTS 3,769,479 10/1973 Leeds ..... 200/148 A

FOREIGN PATENT DOCUMENTS 1540062 10/1970 Fed. Rep. of Germany .

1665048 1/1971 Fed. Rep. of Germany .

2211617 1/1976 Fed. Rep. of Germany .

*Primary Examiner*—J. V. Truhe

*Assistant Examiner*—Morris Ginsburg

*Attorney, Agent, or Firm*—Spencer & Kaye

[57] ABSTRACT

A gas-blast circuit breaker having cooperating stationary and movable power contacts, a movably arranged cylinder, a stationary piston disposed in the cylinder and slidable with respect thereto, a compression chamber defined by an end face of the piston and the inside of the cylinder, a drive rod operatively connected to the cylinder and the movable power contact for displacing them relative to the piston and the stationary power contact, respectively, a nozzle affixed to the cylinder and having an opening oriented towards the location where an electric arc is generated between the stationary and movable power contacts during displacement of the movable power contact away from the stationary power contact and a hollow guide sleeve connected to the drive rod and movable therewith as a unit. The movable power contact is supported within the guide sleeve and is displaceable with respect thereto.

21 Claims, 5 Drawing Figures

GAS-BLAST CIRCUIT BREAKER

BACKGROUND OF THE INVENTION

This invention relates to a circuit breaker which includes cooperating stationary (fixed) and movable power contacts as well as an arrangement for blowing out the electric arc drawn during contact separation. The arrangement has a gas compressing device formed of a stationary piston and a cylinder moved by a drive rod, as well as a nozzle made of an insulating material which is affixed to the cylinder.

A gas-blast circuit breaker of the above-outlined type is conventional and is disclosed, for example, in German Laid-Open Application (Offenlegungsschrift) No. 2,363,171. In the structure described therein the movable power contact is affixed to the nozzle and the cylinder of the gas compressing device. For a circuit breaking operation, the cylinder is moved with respect to a stationary piston disposed therein, whereupon the gas contained in the cylinder is pre-compressed. A gas flow from the cylinder is generated only when the moving nozzle is no longer closed by the stationary power contact, whereupon the arc drawn between the contacts is exposed to an air blast.

It is a disadvantageous characteristic of the above construction, particularly as concerns the efficiency of the circuit breaking operation, that prior to the beginning of the gas blast, the arc burns in an environment of increased gas pressure (caused by the pre-compression) within the nozzle. As a consequence, that zone of the nozzle which plays the most important role in the subsequent extinction of the arc is heated and is soiled with soot originating from the contacts.

Further, the initially fresh blowout gas is contaminated by ionized gas within the nozzle and partially in the compression chamber as well (by virtue of backflow).

If, in a circuit breaker structure of the above-described type there is to occur a reverse gas blast into the hollow movable contact pin, it may be of advantage to close the flow path by means of an additional valve device during the compression phase, such as disclosed in German Pat. No. 2,329,501.

It is an advantage of the above-outlined structure that the gas flow path leading to the nozzle is very short.

Another type of an arc blowout circuit breaker is disclosed, for example, in German Laid-Open Application (Offenlegungsschrift) No. 2,108,871 and German Patent Application M3368 filed May 16th, 1950 and published on July 3rd, 1952. The structure disclosed therein comprises a nozzle which is made of an insulating material and which is stationary with respect to the stationary contact and the gas compressing piston. Thus, the nozzle does not move together with the movable contact. The movable contact first closes the nozzle and is, for performing the circuit breaking operation, drawn into the stationary nozzle. The gas blast starts only when the movable contact is in a fully drawn-in condition within the nozzle. The above-outlined second type of construction has the advantage that the arc first burns externally of the nozzle and then burns in the inside thereof, but with small power and in an environment of low gas pressure. As a result, substantially less combustion products are generated. Since the compression chamber in which the pre-compressed extinguishing gas is contained, is first closed off by the contact pin, the fresh gas is prevented from mixing with the ionized gas. Further, the pre-compression occurs without any gas loss. That zone of the nozzle which is of prime importance in extinguishing the arc is exposed to the arc only for a very short period. The movable contact (contact pin) opens the gas compressing chamber and allows the gas blast to begin only after the necessary extinguishing distance between the contacts is attained.

It is a disadvantage of the circuit breakers of the above-outlined second type that the gas compressing devices necessarily have a relatively long gas flow path between the compression chamber and the nozzle. Such a long flow path, because of the inherently high flow resistance, causes an undesired pressure drop. Further, the flow paths form a dead space which, in the structure disclosed in German Laid-Open Application No. 2,108,871, is additionally increased during the compression phase. Since the gas in this chamber cannot be displaced by the piston, the desirable very high compression values cannot be achieved.

It is a further disadvantage of the known circuit breaker structures that after releasing the gas blast, the compression stroke is in most cases already terminated, so that during the extinguishing phase the gas pressure drops relatively rapidly.

SUMMARY OF THE INVENTION

It is an object of the invention to provide an improved gas-blast circuit breaker in which the advantages of the above-outlined two types of structures are combined. In particular, the invention seeks to provide a gas-blast circuit breaker which is of simple construction and achieves a very high gas compression, although the gas flow paths are short. It is a further object to ensure that until the extinguishing distance between the power contacts is reached, as little extinguishing gas as possible is lost and further, the energy conversion along the switching path is small, the arcing period is short and also, subsequent to starting the gas blast, continued compression of the gas is possible.

These objects and others to become apparent as the specification progresses, are accomplished by the invention, according to which, briefly stated, the gas-blast circuit breaker has cooperating stationary and movable power contacts, a movably arranged cylinder, a stationary piston disposed in the cylinder and slidable with respect thereto, a compression chamber defined by an end face of the piston and the inside of the cylinder, a drive rod operatively connected to the cylinder and the movable power contact for displacing them relative to the piston and the stationary power contact, respectively, a nozzle affixed to the cylinder and having an opening oriented towards the location where an electric arc is generated between the stationary and movable power contacts during displacement of the movable power contact away from the stationary power contact and a hollow guide sleeve connected to the drive rod and movable therewith as a unit. The movable power contact is supported within the guide sleeve and is displaceable with respect thereto.

DESCRIPTION OF THE PREFERRED EMBODIMENTS

It is noted at the outset that components which play no appreciable role with reagard to the invention such as details of the circuit breaker drive, supporting insulators, housing, parallel capacitors, etc. are not shown in the Figures for the sake of clarity.

Figure 1:
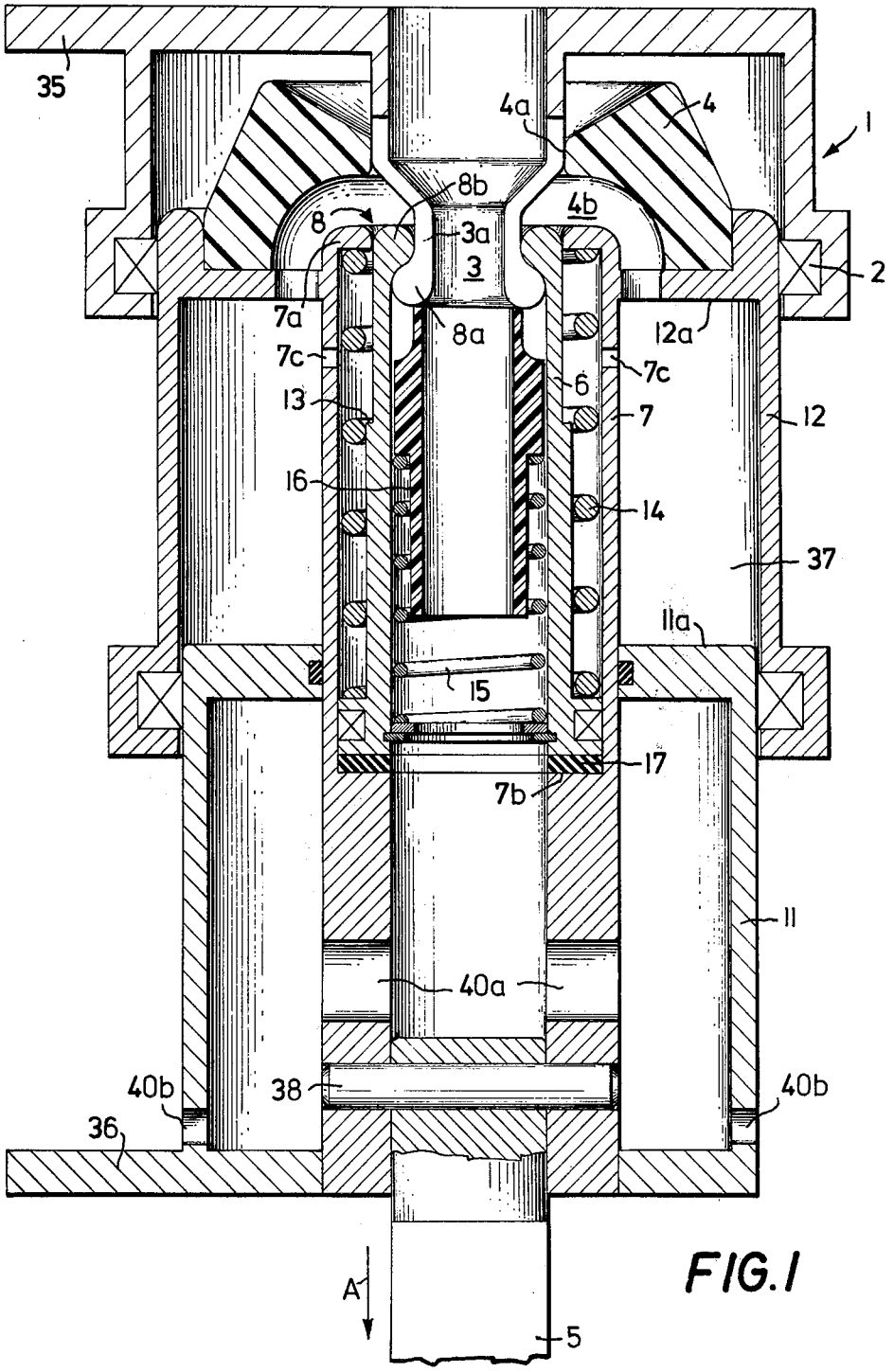
FIG. 1 is a longitudinal sectional view of a preferred embodiment of the invention, illustrating the structure in the closed position.
Figure 2:
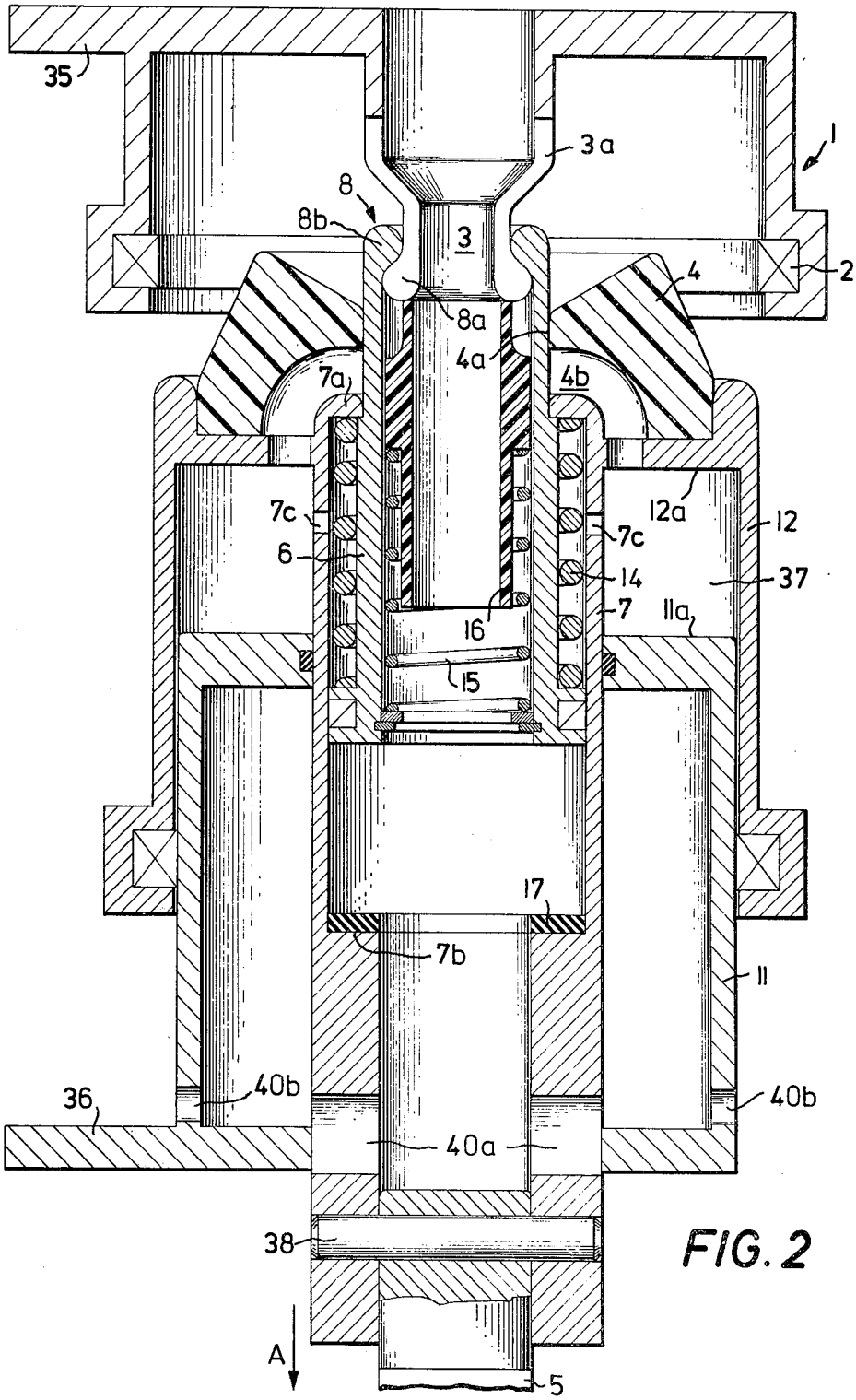
FIG. 2 is a longitudinal sectional view of the same embodiment immediately prior to contact separation.
Figure 3:
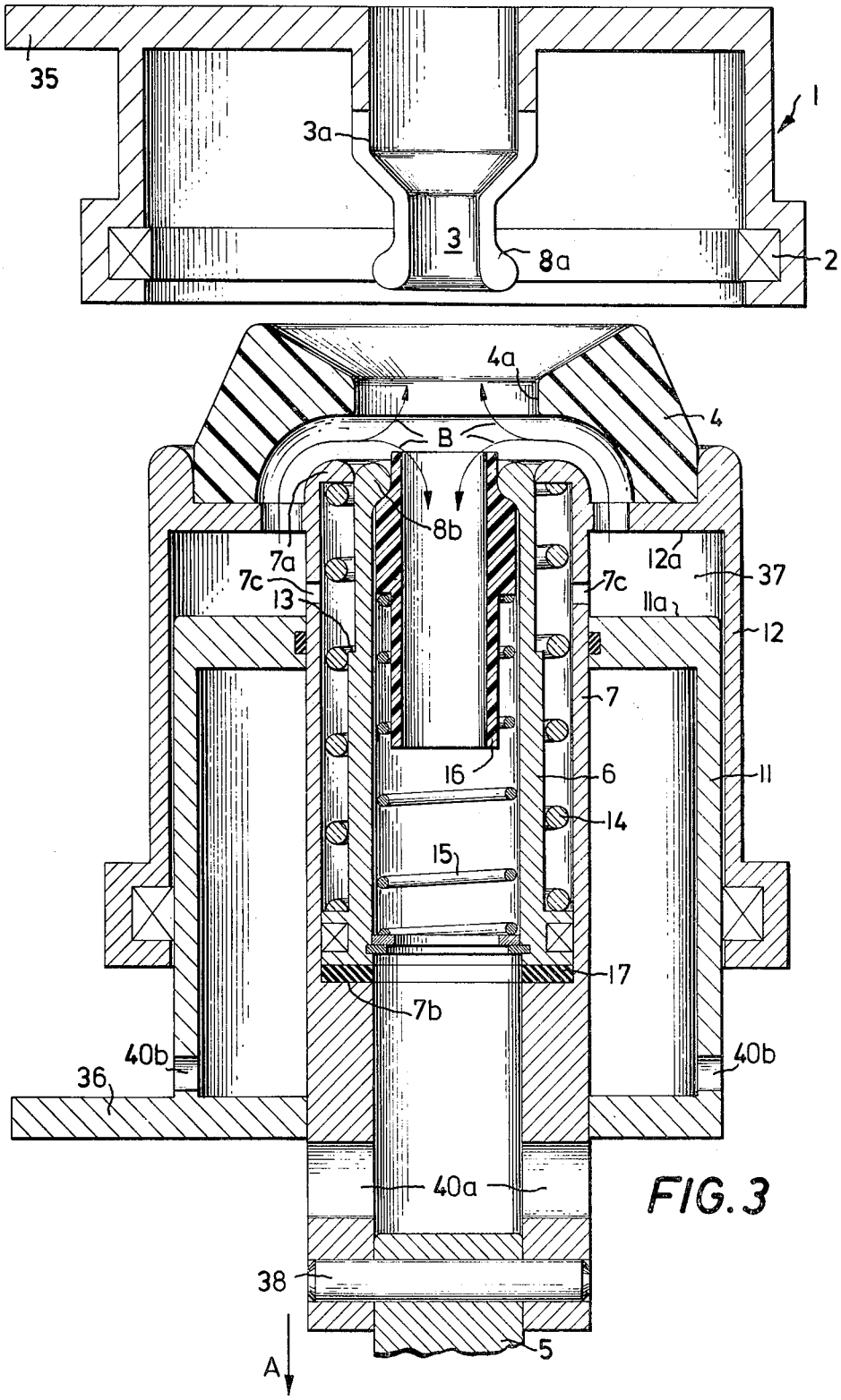
FIG. 3 is a longitudinal sectional view of the same embodiment during the arc extinguishing phase.

Turning now to FIGS. 1, 2 and 3, the circuit breaker shown therein comprises a stationary (fixed) contact assembly generally indicated at 1 formed of a nominal current contact 2, a power contact 3 and a terminal post 35 electrically connected to the contacts 2 and 3.

A stationary hollow piston 11 is spaced axially from the cylindrical stationary contact assembly 1 and is provided with a workface 11*a*. A terminal post 36 is affixed to the electrically conducting piston 11. A hollow cylinder 12 slidably surrounds the outer face of the piston 11 and is adapted to axially slide thereon and with respect thereto. The workface 11*a* of the piston 11 and the inside of the cylinder 12 define a compression chamber 37 in which, as will be described later, extinguishing gas is compressed during operation. The cylinder 12 has an integral guide sleeve 7 which extends coaxially with the cylinder 12 in the inside thereof.

To the outside of a radially inwardly extending end wall 12*a* of the cylinder 12 there is fixedly mounted a nozzle 4 made of an electrically insulating and heat resistant material. The nozzle 4 has a central nozzle opening 4*a* axially aligned with the cylinder 12.

Within the guide sleeve 7 there is slidably arranged a hollow movable power contact pin 6 projecting outwardly from the open-ended sleeve 7 in the direction of the stationary power contact 3. In the annular space defined between the outer face of the movable power contact 6 and the inner face of the guide sleeve 7 there is arranged a coil spring 14 engaging a radially inwardly directed end face 7*a* of the guide sleeve 7 and urging the movable power contact 6 into the inside of the guide sleeve 7 and away from the stationary contact 3. A radially inwardly directed shoulder 7*b* of the guide sleeve 7 supports a buffer gasket 17 which may be made of a resilient material such as rubber or elastic plastic and which serves to cushion the impact of the movable contact 6 at the end of its travel within the guide sleeve 7.

The guide sleeve 7 extends through a central opening provided in the workface 11*a* of the piston 11 and is articulated by means of a pin 38 to a drive rod 5 constituting the output member of a circuit breaker actuating arrangement (not shown).

Within the hollow movable power contact 6 there is slidably arranged an insulating sleeve 16 urged in the direction of the stationary contact 3 by a coil spring 15 disposed within the power contact 6 and engaging a radially inwardly directed shoulder thereof.

FIG. 1 illustrates the circuit breaker in the fully closed position in which the stationary power contact 3 extends through the nozzle opening 4*a* (thus closing off the same), the power contacts 3 and 6 are in interengagement and the power contact 6 is in its inwardmost position in the guide sleeve 7, urged thereinto by the spring 14.

The interengagement between the power contacts 3 and 6 is effected by means of a locking arrangement 8 to be discussed later in greater detail.

For effecting a circuit breaking operation, the drive rod 5 is moved in the direction of the arrow A away from the stationary contact assembly 1, causing the cylinder 12, the guide sleeve 7 and the nozzle 4 to move as a unit away from the stationary contact assembly 1. An extinguishing gas contained in the chamber 37 of the cylinder 12 is compressed as the volume of the chamber 37 diminishes during this movement. The flow channel 4*b* bounded by an inner wall of the nozzle 4 and communicating with the compression chamber 37 as well as the nozzle opening 4*a* are, at the beginning of this first phase of the circuit breaking operation, closed off by the stationary power contact 3 which is surrounded by the nozzle opening 4*a* with a close fit. During this phase, the movable power contact 6 remains locked to the stationary power contact 3 by virtue of the locking arrangement 8. The latter is formed of a radially outwardly oriented terminal enlargement 8*a* of the stationary power contact 3 and a radially inwardly oriented terminal enlargement 8*b* of the movable power contact 6. The enlargements 8*a* and 8*b* are capable of snapping behind one another into their interengaging position by virtue of the radially inward compressibility of the stationary power contact 3, made possible by axial slots 3*a* provided therein. The slots 3*a* are very narrow to prevent a gas leakage outwardly through the nozzle opening 4*a* while the stationary power contact closes off the nozzle opening 4*a*.

As the nozzle 4 moves away from the stationary power contact 3, it slides onto the still immobile movable power contact 6, surrounding the latter with a close fit.

By virtue of maintaining the movable power contact 6 locked with the stationary power contact 3, the shoulder 7*a* of the guide sleeve 7 causes the coil spring 14 to be compressed, thus "arming" the movable power contact 6.

The end of the above-described first or initial phase of the circuit breaking operation is illustrated in FIG. 2. Thus, (1) the nominal contact 2 has already separated from the electrically conducting cylinder 12; (2) the nozzle 4 has moved away from the stationary power contact 3 and is now closely surrounding the outer cylindrical face of the movable power contact 6, so that the nozzle opening 4*a* is still blocked; (3) the gas in the chamber 37 has undergone pre-compression; (4) the power contact spring 14 is compressed; and (5) the radial shoulder 7*a* of the guide sleeve 7 arrives into contact with a radially outwardly directed shoulder 13 of the movable power contact 6, thus establishing a rigid force path between the drive rod 5 and the movable power contact 6.

The further movement of the drive rod 5 introduces the second phase of the circuit breaking operation by causing now the movable power contact 6 to shift with the cylinder 12 as a unit. As a result, the movable power contact 6 frees itself from the locking effect of the locking arrangement 8 (by radially compressing the stationary power contact 3) and moves away from the stationary power contact 3. This occurrence initiates the third operational phase, during which the energy of the compressed spring 14, freed by the release of the locking engagement between the power contacts 3 and 6, accelerates the movable power contact 6 into the guide sleeve 7 away from the stationary power contact 3. At the same time an electric arc is generated which, as long as the outer face of the movable power contact 6 still blocks the nozzle opening 4*a* is not yet exposed to a gas blast.

Instead of the compression spring 14, or in addition thereto, the movable power contact 6 may also be moved by gas pressure in the direction away from the stationary power contact 3. For this purpose, the annular chamber between the guide sleeve 7 and the movable power contact 6 communicates with the compression chamber 37 by means of ports 7*c* provided in the guide sleeve 7 in the vicinity of the end wall 12*a* of the cylinder 12.

Only when, in a successive fourth operational phase, the movable power contact 6 has moved away from the nozzle 4, thus unblocking the nozzle opening 4*a* and the channel 4*b*, is the pre-compression of the gas terminated and the gas blasting of the arc with the pre-compressed extinguishing gas begins. The moment of the contact separation and the velocities of the drive rod 5 and the movable power contact 6 are coordinated with respect to one another in such a manner that in that moment the pressure of the extinguishing gas and the distance between the power contacts reach a sufficient magnitude for interrupting the current. The air blast is prolonged by virtue of a further reduction of the size of the compression chamber 37 as the drive rod 5 continues its motion in the direction of the arrow A. As indicated by the arrows B in FIG. 3, the extinguishing gas flow performs its work and passes into the atmosphere in part through the nozzle opening 4*a* in the direction of the stationary power contact 3 and in part, as a reverse blast, through the hollow movable power contact 6 through ports 40*a* and 40*b* provided in the guide sleeve 7 and in the piston 11, respectively. FIG. 3 illustrates the terminal open position of the gas-blast circuit breaker, in which the movable power contact 6 is in engagement with the shoulder 7*b* of the guide sleeve 7 with the intermediary of the buffer gasket 17.

Referring once again to FIGS. 1 and 2, it is seen that in the fully closed position of the circuit breaker the insulating sleeve 16 is biased by the spring 15 against a terminal rim of the stationary power contact 3. As may be observed in FIG. 3, after separation of the power contacts 3 and 6 has occurred, the insulating sleeve 16 is shifted upwardly by the spring 15 and conforms to the terminus of the movable power contact 6 to thus protect the locking arrangement 8 from the effects of the electric arc drawn between the separated power contacts 3 and 6.

A re-closing of the circuit breaker and an automatic locking of the power contacts 3 and 6 are effected by displacing the drive rod 5 in a direction opposing that of the arrow A.

Figure 4:
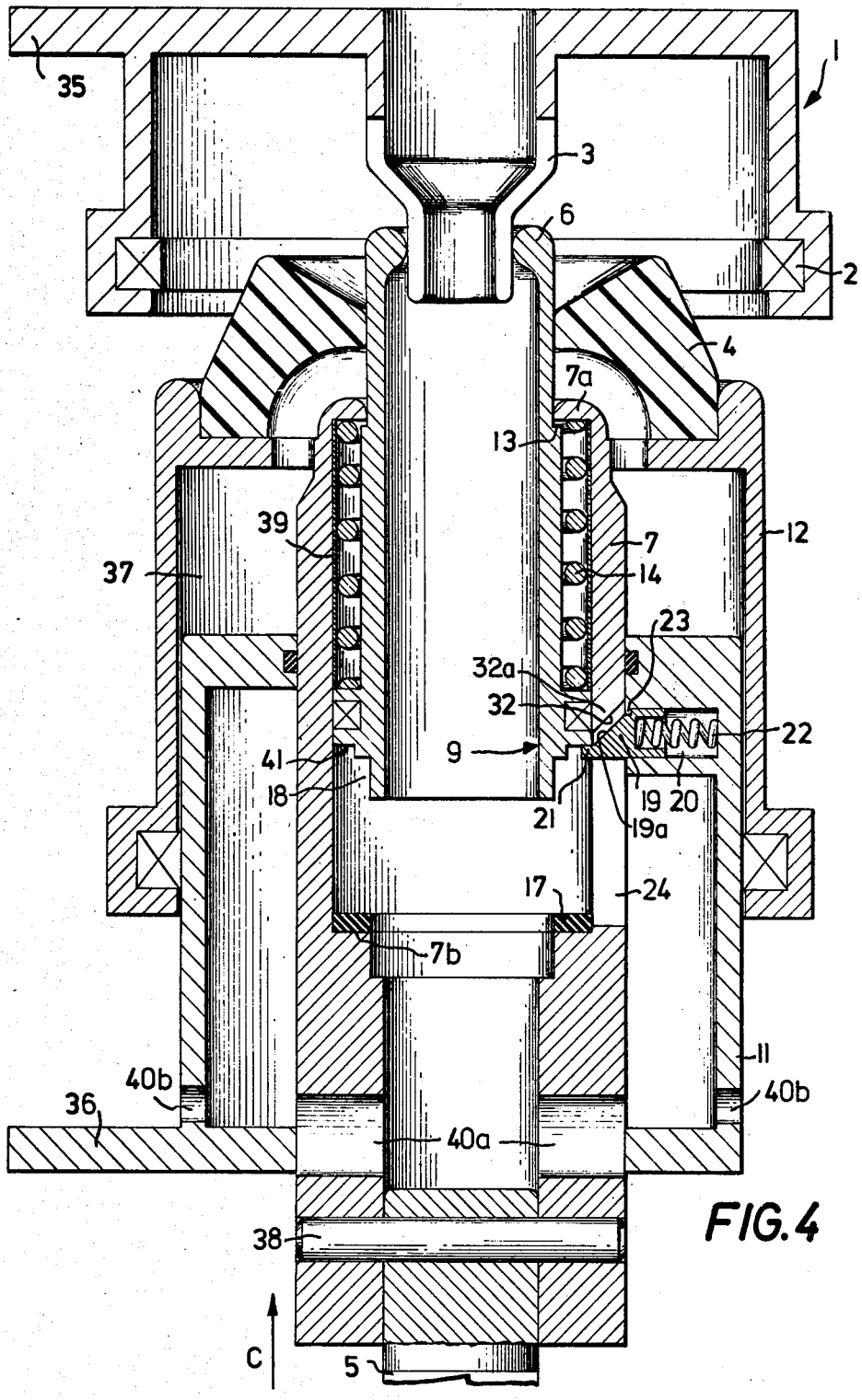
FIG. 4 is a longitudinal sectional view of another preferred embodiment of the invention immediately prior to contact separation.

Turning now to the embodiment illustrated in FIG. 4, the latter differs from the first-described embodiment in the power contact locking device which is designated at 9 and which is located in the hollow stationary piston 11. This feature has the advantage that the locking device is not exposed to the arc.

The locking device 9 is formed of a plurality of chamferred latch members 19 (only one shown) which are distributed about the circumference of the guide sleeve 7 and which are radially slidably supported in respective radial bores 20 of the piston 11. Each latch member 19 has, at its outer terminus, a radial projection 21 for engaging the movable power contact 6 at a radially outwardly extending annular shoulder 41 thereof. The latch members 19 are urged by respective compression springs 22 outwardly of their bores 20 against an abutment 23. The guide sleeve 7 is provided with a plurality of longitudinal (axially parallel) slots 24 (only one shown), each being associated with a latch member 19 to ensure that each latch member is capable of projecting inwardly through the guide 7.

FIG. 4 illustrates the circuit breaker at a moment immediately prior to the release of the movable power contact 6 (that is, immediately prior to contact separation). Shortly before the shoulder 13 of the movable power contact 6 abuts the shoulder 7*a* of the guide sleeve 7, an inclined face 32 of the guide sleeve 7 engages an inclined face 19*a* of the respective latch member 19 so that the latch members 19 are—by camming action —urged radially outwardly, that is, radially away from the respective annular shoulder 41 causing disengagement between the projections 21 and the shoulder 41, whereby the movable power contact 6 is released and, as described earlier, accelerated by the spring 14. It is noted that each projection 21 is arranged only in the center of the inclined front face of the corresponding latch member 19 and may project into a corresponding groove 322 provided in the inclined surface 32 of the guide sleeve 7. In this manner it is ensured that the latch members 19 are pushed entirely back into the radial bores 20. A blocking sleeve 39 attached to the movable power contact 6 prevents a penetration of the latch members 19 in between the turns of the spring 14 when the movable power contact is fully retracted into the guide sleeve 7.

For closing the circuit breaker, the drive rod 5 is moved in the direction of the arrow C, whereupon the shoulder 7*b* displaces the movable power contact 6 towards the stationary power contact 3 and the latch members 19 lock behind the shoulder 41 of the movable power contact 6.

Figure 5:
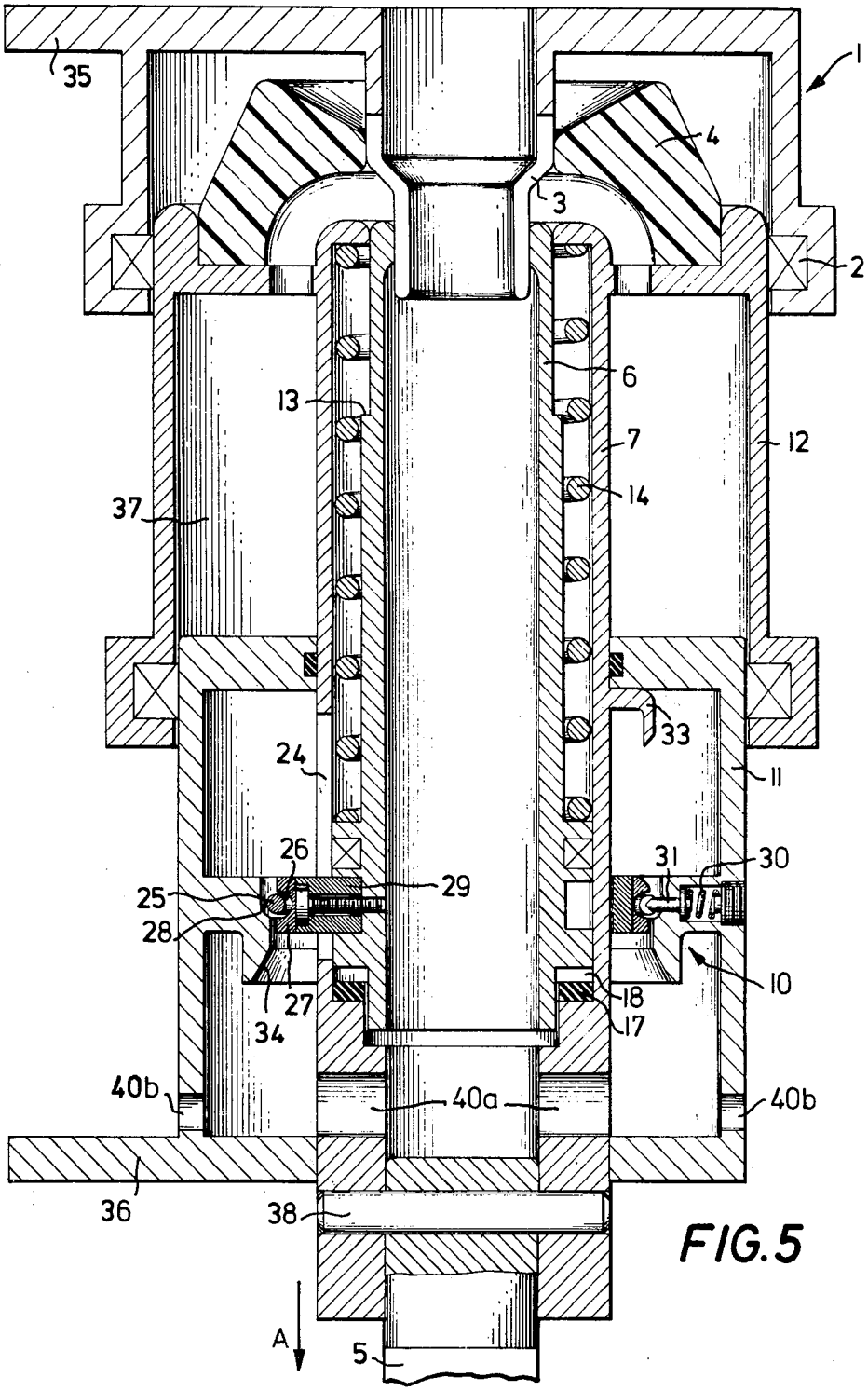
FIG. 5 is a longitudinal sectional view of a further preferred embodiment of the invention shown in the closed position.

Turning now to FIG. 5, there is illustrated a contact locking device 10 constituting a further variant. Thus arrangement is known by itself and is described as a "piston ring lock" in German Pat. No. 1,540,062. This type of locking arrangement has the advantage over a pawl-type lock that the generated force is distributed over a relatively large surface and thus very large forces may be controlled.

The locking device 10 shown in FIG. 5 comprises a piston ring 25 which is supported in an annular groove 26 of a carrier ring 27 and which, in the locking position, is in engagement with an annular surface 28 of the piston 11. The carrier ring 27 is attached to a plurality of pins 29 which are distributed over the circumference of the movable power contact 6. Each pin 29 projects radially inwardly through longitudinal (axially parallel) slots 24 (only one shown) provided in the guide sleeve 7. A pin 31 biased by a compression spring 30 serves for spreading the split piston ring 25 in its locked condition.

To effect circuit breaking, the drive rod 5 and thus the guide sleeve 7 are moved in the direction of the arrow A. As soon as the pin 31 is pushed radially outwardly against the force of the spring 30 by an axially oriented, chamferred pin 33 affixed to the outer face of the guide sleeve 7, the piston ring 25 is pressed into a groove 26 of the carrier ring 27 by the slanted ring face 28 and thus the movable power contact 6 is released. The latter is then accelerated by the spring 14 and is, in its terminal position, decelerated (dampened) by a gas cushion 18 and a buffer ring 17 made, for example of a synthetic material.

For re-closing the switch, the piston ring 25 is, during the motion of the guide sleeve 7 towards the stationary power contact 3, compressed by the camming effect of an inclined ring face 34 integral with the piston 11 and is brought into its position shown in FIG. 5.

The advantages of the gas-blast circuit breaker designed according to the invention may be summarized as follows:

(1) The spring-assisted rapid opening motion of the movable power contact ensures a short arcing period before the arc extinguishing distance between the power contacts is reached.

(2) Gas blasting of the arc occurs only after the extinguishing distance between the power contacts has been reached.

(3) Before the power contacts reach the extinguishing distance, the arc burns in an environment of low gas pressure, resulting in a reduced scorching of the contacts and the nozzle, whereby the switching life of the individual circuit breaker component is increased.

(4) That zone of the nozzle which is essential for the extinction of the arc is exposed to the arc only when the power contacts are in the arc extinguishing position.

(5) The compression chamber is separated from the arc until the extinguishing position is reached, thus no contamination of the fresh gas can occur.

(6) The flow path from the compression chamber to the nozzle is very short ensuring that only a small pressure drop will occur.

(7) The compression chamber has only very small dead spaces so that a high final gas pressure may be reached.

(8) The compression of the extinguishing gas continues during gas blasting after the minimum extinguishing distance between the power contacts is reached.

(9) No valve arrangement for the movable hollow power contact is necessary to prevent a premature reverse gas blasting.

It will be understood that the above description of the present invention is susceptible to various modifications, changes and adaptations, and the same are intended to be comprehended within the meaning and range of equivalents of the appended claims.

What is claimed is:

1. In a gas-blast circuit breaker including a stationary power contact, a movable power contact cooperating with the stationary power contact to assume an engaged or a disengaged state therewith; a stationary piston having a workface; a cylinder slidably arranged on the piston and defining, together with the workface of the piston, a compression chamber for compressing an arc extinguishing gas therein upon relative movement of the piston into the cylinder; an insulating nozzle affixed to one end of the cylinder and having a nozzle opening oriented towards the stationary power contact where an electric arc is generated between the stationary and movable power contacts during displacement of the movable power contact away from the stationary power contact, said nozzle opening communicating with the compression chamber; and a drive rod operatively connected to the cylinder and the movable power contact for displacing the cylinder with respect to the piston and for displacing the movable power contact with respect to the stationary power contact; the improvement comprising a guide sleeve fixedly attached to said cylinder and being surrounded thereby; said movable power contact being slidably received in said guide sleeve for displacement with respect to said guide sleeve and said drive rod; a compression spring means for urging said movable power contact into said guide sleeve away from said stationary power contact; means for arming said compression spring means during an initial phase of the displacement of said cylinder and said guide sleeve away from said stationary power contact by said drive rod; locking means for maintaining said movable power contact immobilized and in engagement with said stationary power contact during said initial phase; and unlocking means for disengaging said movable power contact from said stationary power contact at the end of said initial phase for releasing the potential energy of said compression spring means, whereby said movable power contact is accelerated into said guide sleeve away from said stationary power contact; and further wherein the cross-sectional outline of said movable power contact is substantially identical to the outline of said nozzle opening, whereby said movable power contact is surrounded by said nozzle opening with a close fit in the course of said initial phase of displacement of said cylinder and said guide sleeve away from said stationary power contact by said drive rod.

2. A gas-blast circuit breaker as defined in claim 1, wherein said drive rod is attached to said guide sleeve.

3. A gas-blast circuit breaker as defined in claim 1, wherein the circuit breaker has a fully closed position; said stationary power contact extends through and blocks said nozzle opening in said fully closed position.

4. A gas-blast circuit breaker as defined in claim 1, wherein said movable power contact is constituted by a hollow pin; the improvement further comprising an insulating sleeve slidably supported in said hollow pin and a spring urging said insulating sleeve towards said stationary power contact; said insulating sleeve being surrounded by a terminal portion of said movable power contact in the disengaged state of the power contacts.

5. A gas-blast circuit breaker as defined in claim 1, further comprising a radially inwardly extending shoulder arranged in the inside of said guide sleeve; said shoulder constituting a stop for said movable power contact for determining the innermost position of said movable power contact within said guide sleeve; and a buffer means for braking the motion of said movable power contact towards said shoulder.

6. A gas-blast circuit breaker as defined in claim 5, wherein said buffer means comprises a buffer gasket supported on said shoulder.

7. A gas-blast circuit breaker as defined in claim 1, said unlocking means comprising coupling means for establishing a rigid power path between said drive rod and said movable power contact at a point during the displacement of said guide sleeve away from said movable power contact maintained in engagement with said stationary power contact by said locking means; said drive rod effecting, through said coupling means, a release of said movable power contact from said stationary power contact by overcoming the locking force of said locking means.

8. A gas-blast circuit breaker as defined in claim 1, wherein said movable power contact and said guide sleeve define an annular space accommodating said compression spring means.

9. A gas-blast circuit breaker as defined in claim 7, wherein said movable power contact is hollow and has an open end oriented towards said stationary power contact; and wherein the open end of said movable power contact receives and surrounds an end of said stationary power contact when said power contacts are in engagement with one another; said locking means comprising an annular, radially inwardly oriented terminal enlargement formed on said open end of said movable power contact and an annular, radially outwardly oriented terminal enlargement formed on said end of said stationary power contact; said terminal enlargements interengaging behind one another when said power contacts are in engagement with one another.

10. A gas-blast circuit breaker as defined in claim 9, wherein said stationary power contact is hollow and radially compressible for overcoming the force of said locking means and separating said power contacts from one another by the force of said drive rod.

11. A gas-blast circuit breaker as defined in claim 7, wherein said locking means comprises means defining a plurality of circumferentially distributed, radially inwardly oriented and radially inwardly open bores provided in said stationary piston and a plurality of latch members each slidably received in a separate one of said bores; each latch member having a radially inwardly oriented projection for locking said movable power contact and a first inclined face cooperating with respective second inclined faces of said guide sleeve for displacing each said latch member by said guide sleeve into the respective bore to disengage said locking means by the force of said drive rod; said first and second inclined faces being comprised in said unlocking means.

12. A gas-blast circuit breaker as defined in claim 11, further comprising a spring disposed in each said bore for urging each latch member outwardly from the respective bore; said means defining the bores further having abutments associated with each bore for limiting the outward movement of each latch member from its respective bore.

13. A gas-blast circuit breaker as defined in claim 11, further comprising means defining a plurality of circumferentially distributed longitudinal slots provided in said guide sleeve; each said slot being in alignment with a respective latch member for providing passage of the respective latch member through the associated slot; each slot terminating in a said second inclined face cooperating with said first inclined face of the respective latch member for displacing the latch member into the respective bore to disengage said locking means by the force of said drive rod through said coupling means.

14. A gas-blast circuit breaker as defined in claim 1, wherein said locking means comprises (a) a radially retractable ring surrounding said movable power contact;

(b) securing means attaching said ring to said movable power contact to be carried thereby;

(c) an annular engagement face forming part of said stationary piston and being in alignment with said ring; said ring being normally in a radially outwardly spread state and being in a locking engagement with said annular engagement face while said power contacts are in engagement with one another; and (d) camming means attached to and carried by said guide sleeve for causing said ring to retract from said annular engagement face during the displacement of said guide sleeve away from said stationary power contact; said camming means forming part of said unlocking means.

15. A gas-blast circuit breaker as defined in claim 14, wherein said securing means comprises a plurality of securing bolts attached circumferentially to said movable power contact and to said ring; further comprising means defining, in said guide sleeve, longitudinal slots aligned with respective securing bolts for providing passage of the securing bolts through said slots to support said ring externally of said guide sleeve.

16. A gas-blast circuit breaker as defined in claim 14, wherein said locking means further comprises spreader means arranged in said stationary piston for urging said ring into said radially outwardly spread state.

17. A gas-blast circuit breaker as defined in claim 16, wherein said spreader means includes a pin and a spring urging the pin into engagement with said ring.

18. A gas-blast circuit breaker as defined in claim 16, wherein said camming means comprises a chamfered pin affixed to said guide sleeve for moving said spreader means away from said ring.

19. A gas-blast circuit breaker as defined in claim 14, further comprising a slanted annular cam face forming part of said stationary piston and oriented in a direction away from said stationary contact for temporarily compressing said ring and allowing it to pass onto said annular engagement face during displacement of said guide sleeve and said movable power contact from a fully open position towards said stationary power contact.

20. A gas-blast circuit breaker as defined in claim 7, wherein said coupling means includes a radially inwardly extending shoulder forming part of said guide sleeve and a radially outwardly extending shoulder forming part of said movable power contact; said shoulders being spaced from one another in the fully closed position of the circuit breaker and being in a force-transmitting engagement at said point during the displacement of said guide sleeve away from said stationary power contact.

21. A gas-blast circuit breaker as defined in claim 1, further comprising an annular space defined by said guide sleeve and said movable power contact, means maintaining communication between said compression chamber and said annular space for introducing gas compressed in said compression chamber into said annular space; the force derived from the compressed gas in said annular space aiding the force exerted by said compression spring means.

* * * * *